US006666925B2

(12) United States Patent
Brackett et al.

(10) Patent No.: US 6,666,925 B2
(45) Date of Patent: Dec. 23, 2003

(54) PAINT BRUSH CLEANING DEVICE

(75) Inventors: Ted J. Brackett, Manhattan Beach, CA (US); C. Martin Smith, Los Angeles, CA (US); Mark Anderson, Woodland Hills, CA (US)

(73) Assignee: Dynamic Cleaning Technologies LLC, Los Angeles, CA (US)

( * ) Notice: Subject to any disclaimer, the term of this patent is extended or adjusted under 35 U.S.C. 154(b) by 0 days.

(21) Appl. No.: 10/002,365

(22) Filed: Nov. 1, 2001

(65) Prior Publication Data

US 2002/0050280 A1 May 2, 2002

Related U.S. Application Data

(60) Provisional application No. 60/245,078, filed on Nov. 1, 2000.

(51) Int. Cl.[7] ..... A46B 17/06
(52) U.S. Cl. ..... 134/6; 15/21.1; 15/38
(58) Field of Search ..... 15/21.1, 38, 39, 15/88.4, 104.92; 134/6

(56) References Cited

U.S. PATENT DOCUMENTS 1,542,025 A * 6/1925 Ballman ..... 15/38
2,082,991 A * 6/1937 Turco ..... 15/39
2,354,898 A * 8/1944 Wiksten ..... 15/38 X
3,058,134 A * 10/1962 Wozniak-Rennek ..... 15/38
4,403,364 A * 9/1983 Schroeder ..... 15/38 X
4,912,797 A * 4/1990 Brackett ..... 15/38

FOREIGN PATENT DOCUMENTS

WO WO 90/11900 * 10/1990

* cited by examiner

*Primary Examiner*—Mark Spisich
(74) *Attorney, Agent, or Firm*—Cislo & Thomas LLP

(57) ABSTRACT

The paintbrush-cleaning device includes a housing with an open top, a bottom drain and a central space, containing paintbrush-cleaning liquid therein. A pair of rotatable radial brushes brackets the paintbrushes in the central space and are powered by an electric motor connected to the housing. A number of spaced upwardly directed jet nozzles are disposed in the central space and direct streams of cleaning liquid under pressure upwards towards the paintbrushes. An impeller pump may be connected to a manifold in the central space, from which manifold the jet nozzles extend. Two radial brushes may be used, with the members disposed opposite each other adjacent the sides of the top opening. The radial brushes bear a bristle portion comprising cleaning bristles, which is configured in a spiral along the length of the radial wound brush. The spiral pattern and placement of the radial brushes in the central space effectively clean paintbrushes while transporting cleaning fluid upward and forward from the central space to the paintbrushes via the Archimedes screw principle. The device is simple, durable and efficient.

22 Claims, 7 Drawing Sheets

FIG. 6a
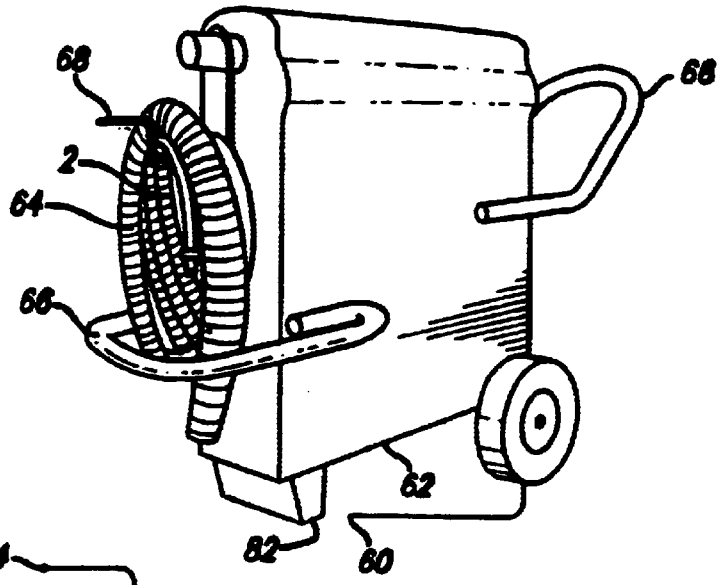
FIG. 6b
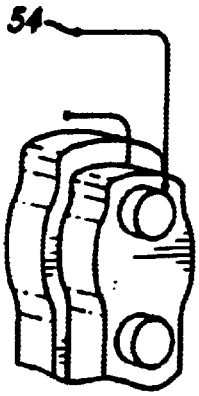
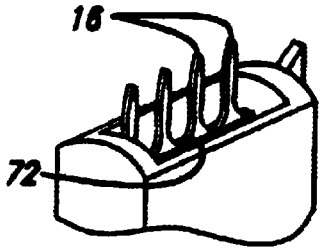
FIG. 6c

PAINT BRUSH CLEANING DEVICE

CROSS-REFERENCES TO RELATED APPLICATIONS

This patent application claims priority from U.S. Provisional Patent Application Ser. No. 60/245,078 filed Nov. 1, 2000 for PAINT BRUSH CLEANING DEVICE, which application is incorporated herein by this reference thereto.

COPYRIGHT AUTHORIZATION

A portion of the disclosure of this patent document contains material which is subject to copyright protection. The copyright owner has no objection to the facsimile reproduction by any one of the patent disclosure as it appears in the U.S. Patent and Trademark Office patent files or records, but otherwise reserves all copyright rights whatsoever.

BACKGROUND OF THE INVENTION

1. Field of the Invention

The present invention generally relates to cleaning means and, more particularly, to an improved paintbrush cleaning device.

2. Description of the Related Art

Various types of paintbrush cleaning devices have been utilized in the past. See, for example, U.S. Pat. No. 1,542,025, which discloses a hand-operated paintbrush cleaner employing a pair of opposed bristle brushes in a pool of cleaning liquid. The cleaning brushes do not engage the paintbrush heel; that is, where the bristles meet the handle and where much unwanted paint tends to accumulate, U.S. Pat. No. 2,737,945 discloses a device designed to dry hardened paint to powder through the use of heating elements, while U.S. Pat. No. 3,112,505 discloses a device that combs out softened paint lumps with a rotary pin comb.

Other patents cover devices wherein cleaning is accomplished by shaking or rotating the paintbrushes themselves. For example, U.S. Pat. No. 4,641,673 discloses a paint roller/paint brush-cleaning device that comprises an open ended tubular housing and a water manifold. The water manifold produces a series of water jets that are aligned with the elongated axis of the housing and which impact either the paint roller or the paintbrush in a slightly offset fashion so that the paint roller or paint brush spins and throws off the diluted paint and the wash water.

U.S. Pat. No. 5,213,121 discloses a brush holder mounted on a container of cleaning fluid that includes clips for engaging the handles of one or more brushes to support the brushes so that the bristles extend vertically into the cleaning fluid. Two vertically-spaced motor-driven cranks, rotatable in synchronism with each other about vertically spaced horizontal axes include a pair of crank pins. The radii of the crank pins from their respective rotational axes are different so that so that the brush holder can be driven up and down and side-wise and a rocking action imparted to the brush and thereby to the bristles. Other patents utilize the cleaning of such objects as golf club heads, hair combs, eyeglasses and hair brushes (see U.S. Pat. Nos. 3,872,534, 2,082,991, 3,464,080 and 3,590,413, respectively). None of such devices provide means useful in removing paint from paintbrush bristles and heels.

There remains a need for a paintbrush cleaning device, which can easily and rapidly remove paint from the bristles of a paintbrush, along the entire length of the bristles, including the heel portion of the brush, without damaging, shaking or rotating the paintbrushes themselves. Such device should be simple, durable and efficient and be capable of being manufactured in a variety of forms to suit individual needs.

SUMMARY OF THE INVENTION

The instant invention is directed to a powered cleaning device that incorporates pressurized water jets, physical brushing action, water agitation and/or solution directional features to clean paintbrushes and satisfies all the foregoing needs. The device comprises a housing with a substantially flat bottom and upraised sidewalls defining an interior communicating with an open top. The interior includes a central space, which is preferably spaced from the sidewalls by approximately three inches (3 inches or 7.62 cm). The device may comprise a lid having an opening in which one or a plurality of paintbrushes can be releasably clamped so that the bristle portion of each paint brush hangs down into the central space for cleaning as disclosed in U.S. Pat. No. 4,912,797, hereby incorporated in its entirety by this reference.

The central space includes a pair of rotatable radial wound brushes bearing a bristle portion comprising elongated cleaning elements, such as bristles or fingers, on their outer surface. The central space and radial wound brushes are preferably configured so that the radial wound brushes are spaced approximately three inches (3 inches or 7.6 cm) from the sidewalls in order to optimize hydrostatic interactions, movement of the cleaning fluid and cleaning of the paintbrushes. The bristle portion of the radial wound brush is preferably configured in a radial spiral pattern about a support column, such that the cleaning solution is transported to the bristles and heel portion of the paintbrush via the Archimedes screw principle as the radial wound brushes rotate. Rotation is preferably imparted to the radial wound brushes by a motor connected to the housing, which may engage one or more V-belt pulleys on the housing via a drive belt.

The ends of the support columns of the radial wound brush may be secured through a removable frame in the housing to tracks or slots in the housing wall so that the radial wound brushes can be spring biased into engagement with opposite sides of the paintbrushes. The spring biasing system can also be used to assist engagement of the gear wheels on the support columns with drive gears connected to the motor. Alternately, the support columns of the radial wound brushes may be disposed in a lateral position in the housing without the use of a frame by fitting the support columns directly into a slot or onto a track in the housing wall. The support columns may also be rotatably mounted in the housing or frame via conventional bearing structures known in the art, such as ball bearings. For example, ball bearings may be fit into a tube or recess into which the support column ends are rotatably supported.

The housing interior also includes a cleaning liquid, such as water or an organic liquid, such as petroleum distillate. The device preferably comprises a bottom drain or discharge outlet, and a plurality of spaced vertically directed jet nozzles for injecting the cleaning liquid under pressure directly into the heel and/or bristles of each paintbrush being cleaned. The nozzles may be in the form of long tubes or needles connected to a manifold, which in turn may be connected to a pressurized source of cleaning liquid, such as a garden hose or an impeller pump connected to the manifold in the central space of the housing interior.

The invention is self-contained, lightweight, and may be configured to permit use in various settings such as hotels, hospitals, corporations, parks and recreation facilities, as well as on streets and highways. For example, the invention may additionally include wheels and hose connections for remote use with local water systems. The system employs airless sprayers and pressure washers that save time and energy resources, extending the useful life of paintbrushes and permits several brushes to be cleaned simultaneously. A combination of solution injection, water agitation, rotating brushes, and employing the Archimedes screw principle permits any commercially available paintbrush to be thoroughly cleaned within 90 seconds without shaking, damaging or rotating the paintbrushes themselves. The device may be used to clean paintbrushes of oil-based as well as water-based paints. Wastewater from the cleaning device may be drained via the bottom drain or discharge outlet into any gray or black water system such as an industrial sink or floor drain.

Various other features of the present invention are set forth in the following detailed description and accompanying drawings.

OBJECTS OF THE INVENTION

It is an object of the present invention to provide an apparatus that effectively cleans paintbrushes of oil-bases and water-based paints. It is a further object of this invention to provide an apparatus that can clean a single paintbrush or simultaneously cleans a plurality of paintbrushes. It is also an object of this invention to provide an apparatus that effectively cleans commercial paintbrushes within approximately ninety seconds. It is a further objective of this invention to provide a paintbrush cleaning apparatus that can be used automatically or semi-automatically. It is another objective of this invention to provide a paintbrush cleaning apparatus that effectively cleans paintbrushes without damaging the bristles or other parts of the brushes so that the paintbrushes may be repeatedly re-used and maintained in good condition for an extended period of time. It is another object of this invention to provide a mobile apparatus for cleaning paintbrushes. It is a further object of this invention to provide an apparatus for cleaning paintbrushes that includes a means of drying the cleaned paintbrushes.

These and other objects and advantages of the present invention will be apparent from a review of the following specification and accompanying drawings.

BRIEF DESCRIPTION OF THE DRAWINGS

FIG. 6*a* is a side perspective view of the paintbrush-cleaning device according to a third embodiment of the present invention.

FIG. 6*b* is a perspective end view of the paintbrush-cleaning device according to a third embodiment of the present invention.

FIG. 6*c* is a top perspective view according to a preferred embodiment of the present invention.

DESCRIPTION OF THE PREFERRED EMBODIMENT(S)

Figure 1:
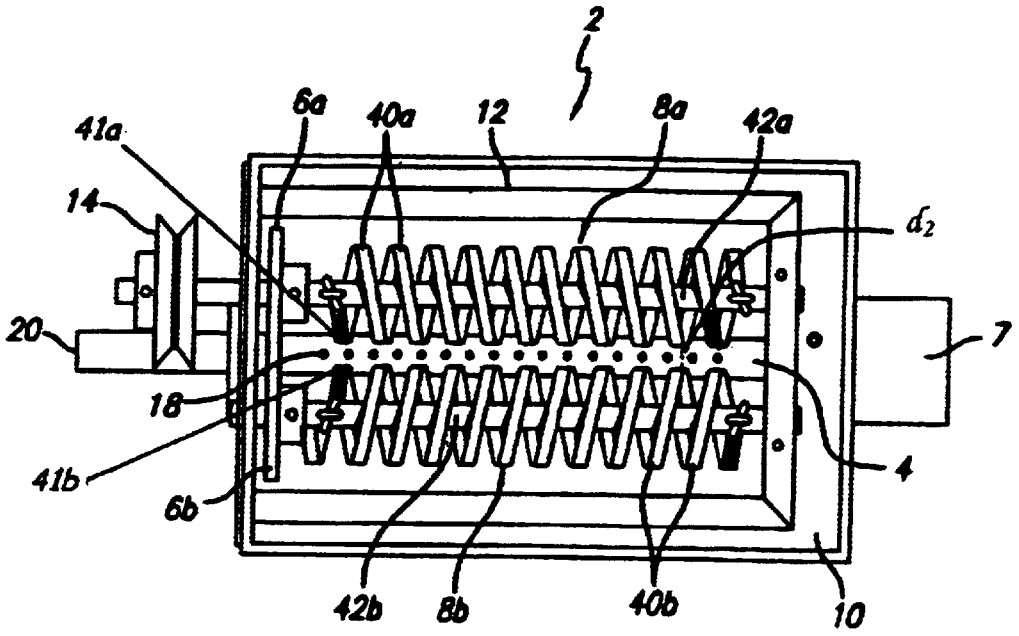
FIG. 1 is a top plan view of the paintbrush cleaning device according to a preferred embodiment of the present invention.

The detailed description set forth below in connection with the appended drawings is intended as a description of presently preferred embodiments of the invention and is not intended to represent the only forms in which the present invention may be constructed and/or utilized. The description sets forth the functions and the sequence of steps for operating the invention in connection with the illustrated embodiments. However, it is to be understood that the same or equivalent functions and sequences may be accomplished by different embodiments that are also intended to be encompassed within the spirit and scope of the invention.

Referring generally to FIGS. 1–7 of the drawings, the device comprises a housing or container 2 having a horizontal bottom 62 and upraised sidewalls 56 defining a housing interior 11, which includes a central space 10 communicating with a top opening 72. The housing 2 is preferably comprised of a lightweight corrosion resistant material such as high-density polyethylene plastic, but may be comprised of other suitable materials such as steel, other metals or plastics. The device may also comprise depending legs 82 and a removable lid (not shown) as disclosed in U.S. Pat. No. 4,912,797. As disclosed in U.S. Pat. No. 4,912,797, the lid may comprise an elongated control opening communicating with the central space and bracketed by a plurality of substantially identical sets of clamps designed to releasably hold a plurality of paint brushes handles, and allow the bristle portion of each brush to depend into the central space and be cleaned.

Figure 2:
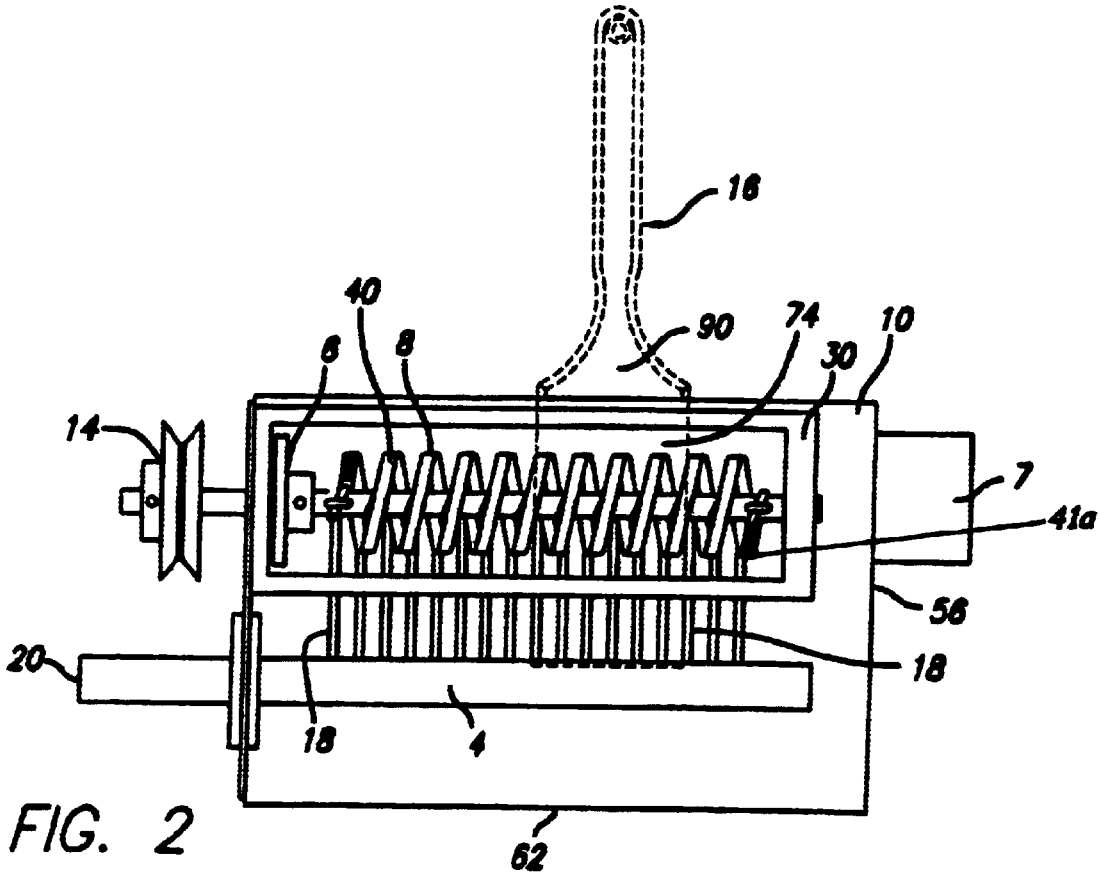
FIG. 2 is a side elevational view of the paintbrush cleaning device according to a preferred embodiment of the present invention.
Figure 3:
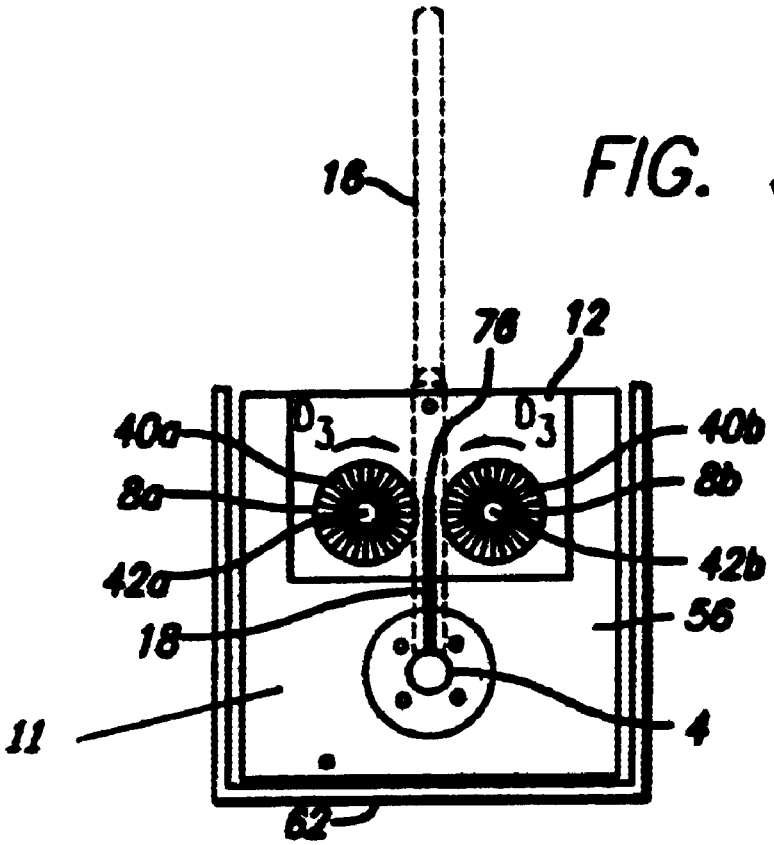
FIG. 3 is a schematic end view of the paintbrush cleaning device according to a preferred embodiment of the present invention.
Figure 4:
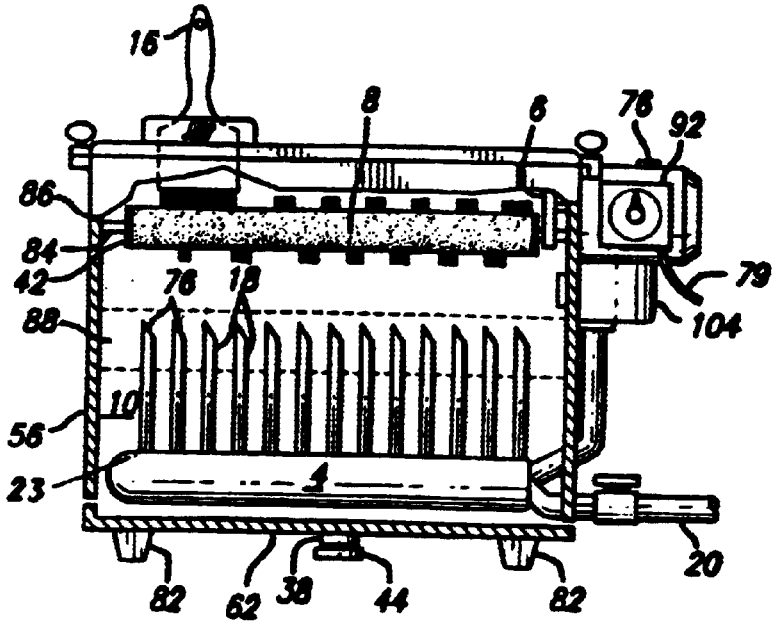
FIG. 4 is a side view of the paintbrush-cleaning device according to a second embodiment of the present invention.

As illustrated in FIGS. 1–3, the housing interior 11 and/or the central space 10 is partly filled with cleaning liquid and the central space 10 preferably contains a pair of radial wound brushes 8*a*, 8*b* disposed on opposite sides of the housing 2, adjacent the top opening 72. In the preferred embodiment, the radial wound brush comprises a bristle portion 40 that is configured in a continuous spiral pattern, preferably about the length of a support column 42, so that the solvent is pushed through the paintbrush 16 via the Archimedes screw principle. The support columns 42*a*, 42*b* a may additionally comprise bars 84 that extend out of the support columns 42 and into tracks or slots 86 disposed in the inner surface 88 of opposite sidewalls 56 of the housing 2 so that the radial wound brush 8 is held in rotatable configuration on opposite sides of the housing 2 (FIG. 4, FIG. 1). The bars 84 may be slip fit inside central openings (not shown) in the support column(s) 42. Alternatively, the track or slot 86 may be configured so that the support column 42 is able to freely rotate within the slot 86, or the support columns may be rotatably mounted in the housing or frame via conventional bearing structures known in the art, such as ball bearings. For example, ball bearings may be fit into a tube or recess disposed in the side walls 56 of the housing 2, into which the support column ends are rotatably supported. The support columns and bearing structures may be configured so that the support columns are able to freely rotate but are fixed to the housing, or may be configured so that the support columns are removable from the housing, such as when the support columns are attached to a removable frame that fits into the housing. The radial wound brushes 8*a*, 8*b* may be urged towards each other to engage the sides of the brush portion 74 of the paintbrush 16, and so that gear 6*a* engages with gear 6*b* to drive the support columns 42*a*, 42*b*, and thereby to the radial wound brushes 8*a*, 8*b* by a spring biasing configuration, such as for example, that disclosed in U.S. Pat. No. 4,912,797.

Figure 5:
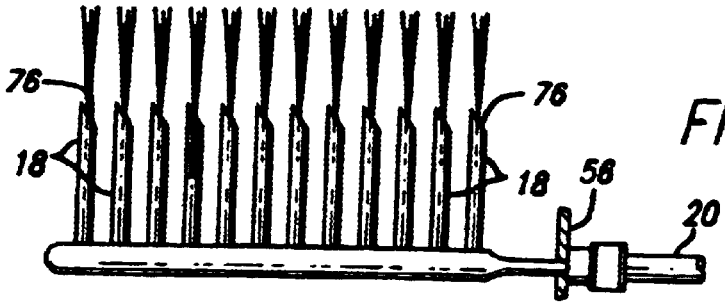
FIG. 5 is a side view of the jet nozzle and manifold configuration according to a preferred embodiment of the present invention.

Referring to FIGS. 4–5, the device includes a distribution manifold 4, preferably disposed in the lower end of central space 10. A solvent inlet 20 extending outward from the housing 2 communicates with the distribution manifold 4 and is preferably approximately three quarters of an inch (¾ inch or 1.8 cm) in diameter. Cleaning liquid may be supplied directly to the distribution manifold 4 under pressure via the inlet 20 connected, in the case of when water is the cleaning liquid, to a garden hose or other water conduit.

The manifold 4 also communicates with a plurality of vertical elongated jet nozzles 18, which preferably have slant pointed upper ends 76 and extend upward in the central space 10 from the distribution manifold 4 towards the paintbrushes 16 and radial wound brushes 8. The jet nozzles 18 are preferably configured to deliver jets of cleaning liquid directly up into the paintbrushes, particularly into the upper heel portion 90 of the paintbrushes 16. In the preferred embodiment, the top end 76 of each jet nozzle 18 is angle cut at an approximately thirty degrees (30°) to approximately sixty degrees (60°) angle and extends about three and one quarter inches (3¼ inches or 8.3 cm) from the upper surface 23 of the manifold 4. The jet nozzles 18 are preferably spaced apart by approximately one half inch (½ inch or 1.27 cm) on center and are preferably approximately one sixteenth of an inch (1/16 inch or 0.159 cm) in diameter. The internal diameter of each jet tube 18 is preferably smaller than that of the manifold 4 so as to increase the relative jet spray force delivered from the jet tube 18.

Excess and dirty cleaning liquid can be drained from the housing 2 through a drain 38 (FIG. 4), which preferably is approximately two inches (2 inches or 5.08 cm) in diameter. Drain 38 may be opened and closed by removing a screw plug 44 that fits into the drain 38 via, for example, threads or a friction fit. If desired, drain 38 can be connected by a hose (not shown) with a pump (not shown), which is also connected to hose, for re-circulation of cleaning liquid to the interior 11 of the housing 2.

The device is configured so that one or more brushes 16, even if of different sizes, can be cleaned simultaneously. A spring biasing system such as, for example, disclosed in U.S. Pat. No. 4,912,797 may be employed for a perfect fit. Alternately, the device may be configured to accommodate paintbrushes 16 of various widths without a spring biasing system. This may be accomplished by providing the support column 42 exterior with a spongy material, which together with the bristle portion 40 of the radial wound brush 8, permit frictionally fitting opposite sides of the paint brush 16 between the spiral wound brushes 8*a*, 8*b*. Alternately, the paintbrushes 16 may be positioned in the central space 10 between the bristle portions 40*a*, 40*b* of the radial wound brushes 8*a*, 8*b* by impaling the heel portion 90 of the paintbrush 16 on the jet nozzles 18, as shown in FIG. 3.

In the preferred embodiment, the device comprises a pair of radial wound brushes 8*a*, 8*b* disposed in the central space 10 of the interior 11 of the housing 2, preferably on opposite sides adjacent the top opening 72, but alternatively may comprise a single, or more than two, radial wound brushes 8. In an apparatus comprising a pair of radial wound brushes 8*a*, 8*b*, the distance between the end tips 41*a*, 41*b* of the bristle portions 40*a*, 40*b* of radial wound brushes 8*a*, 8*b*, $d_2$, is preferably approximately five eights of an inch (⅝ inch or 1.59 cm), although the distance between the end tips 41*a*, 41*b* of the bristle portions 40*a*, 40*b* of radial wound brushes 8*a*, 8*b*, $d_2$, may be configured to accommodate different sizes of paintbrushes. The distance, di, between the spirals of the bristle portion 40 of the radial wound brush 8 is preferably approximately one half inch (½ inch or 1.27 cm) to approximately three quarter inches (¾ inch or 1.9 cm). Individual bristles of the bristle portion 40 of the radial wound brush 8 are each preferably approximately seven eights of an inch (⅞ inch or 2.22 cm) in length and approximately 0.012 inches (0.03 cm) in diameter. Alternatively, the radial wound brush 8 may comprise a spiral pattern of alternating areas of long and/or short slender flexible single fingers and clumps of bristles, as disclosed in U.S. Pat. No. 4,912,797. The individual bristles of the radial wound brush 8 may be comprised of suitable materials known in the art, such as for example, solid nylon #12.

As shown in FIG. 1, a first gear 6*a* in communication with the first support column 42*a* of the radial wound brush 8 engages a second gear 6*b* in communication with the second support column 42*b* of the radial wound brush 8. In the preferred embodiment of the invention, the support columns 42 may also be in communication with at least one V-belt pulley 14, which is disposed on the housing 2. The V-belt pulley 14 is configured, via a drive belt 52, to also communicate with a drive motor pulley 50 engaged with a drive motor (not shown), for example, by way of an output shaft 48. The drive motor may comprise an electric motor, such as a three quarter horsepower 110VAC motor, and has an electrical cord 79.

Figure 6D:
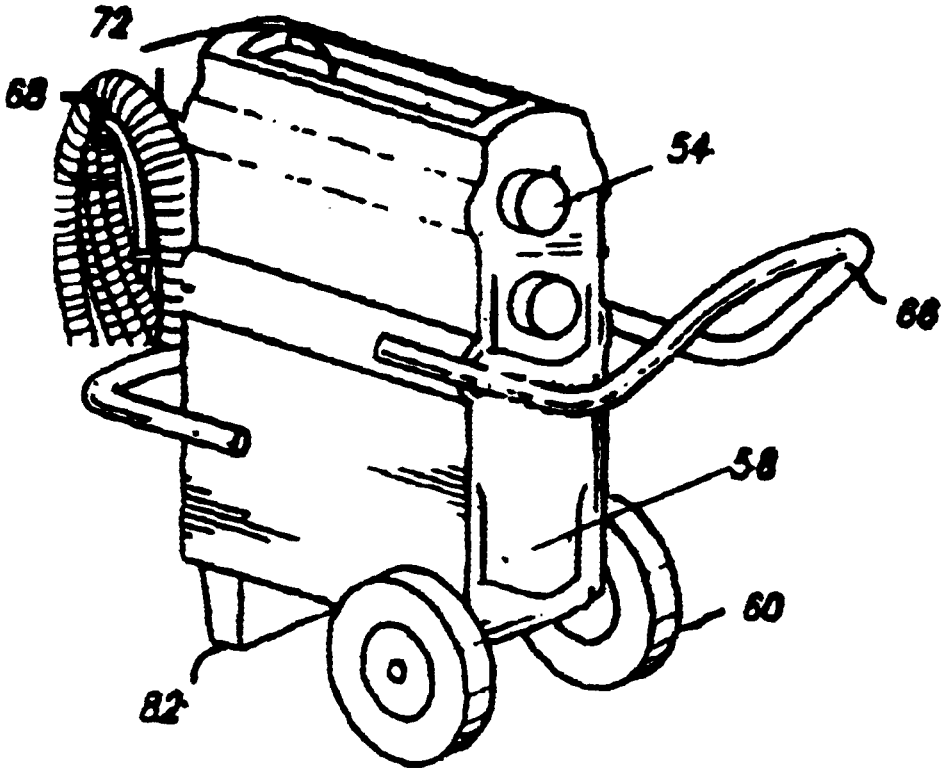
FIG. 6*d* is a side perspective view of the paintbrush-cleaning device according to a fourth embodiment of the present invention.
Figure 7:
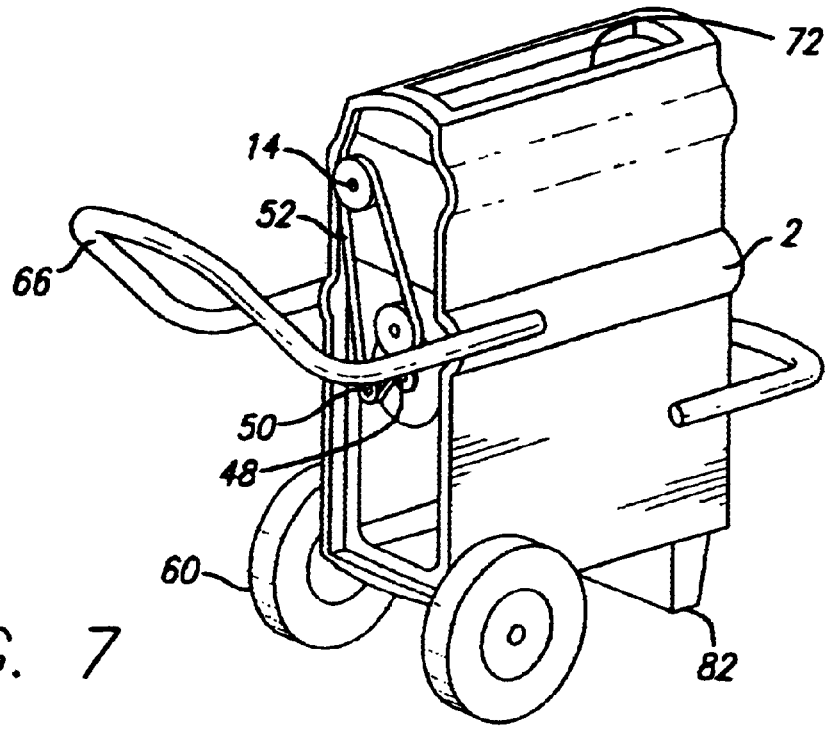
FIG. 7 is an end perspective view of the V-belt, motor pulley and drive belt according to a preferred embodiment of the present invention.

When power is sent to the drive motor, the output shaft 48, if present, and drive motor pulley 50 begin to rotate, thereby causing the drive belt 52 to turn the V-belt pulley 14, which in turn imparts rotation to the support columns 42*a*, 42*b* of the radial wound brushes 8*a*, 8*b*. In the preferred embodiment, the gears 6*a*, 6*b* are configured so that the support columns 42*a*, 42*b* of the radial wound brushes 8*a*, 8*b* both rotate in a direction, $d_3$, toward the interior 11 of the housing 10, as shown in FIG. 3. The motor may include a rheostat 92 and may also be used to power an impeller pump 104 or the like connected to it and to the manifold 4 bearing jet nozzles 18 (FIG. 4). An illuminated on/off power switch (not shown) and a solvent flow control valve 54 may be located in a visible location on the housing 2, such as on the upper corner of the housing 2, as shown in FIG. 6*b*. Alternately, the on/off switch may be located on the electric power cord 79. The housing 2 may also comprise an end pocket 58 as shown in FIG. 6*d* to store a power cord, owner's manual and safety circuit breaker (not shown).

The paintbrush-cleaning device may be stationary or may be configured to be mobile. The mobile unit may be hand-portable or a larger mobile unit, as illustrated in FIGS. 6*a*–*d* and 7. The larger mobile unit preferably includes a pair of tires 60 on at least one end on the bottom 62 of the housing 2 and a hose assembly 64 so that the unit may be hooked up to, for example, a garden hose, industrial sink or shower head connection. A handle 66 may be securely attached to the housing 2 and may include a hose organizer rack, which is preferably comprised of a relatively lightweight material such as powder coated steel or aluminum tubing, for storing a supply hose and/or a discharge hose. Alternately, the hose organizer rack 68 may be located directly on the housing 2, as shown in FIG. 6*a*. The device may also include a powered paintbrush dryer (not shown) attached to the outer portion of the housing 2, preferably adjacent the handle 66, so that cleaned brushes can be moved from the central space 10 for drying and to make room in the central space 10 for cleaning additional brushes. The dryer may comprise air blowing dryers known in the art, such as an electric powered blowing dryer comprising a housing with air inlets and outlets, between which are arranged a means for delivering a flow of warmed or cool air, an air circulation mechanism and an air heating mechanism.

In operation, the user slides the paintbrush(es) 16 through the top opening 72 of the housing 2 into the central space 10. The paintbrushes 16 are oriented in the device so that the bristle end 74 of the paintbrush 16 extends substantially vertically into the central space 10 and are disposed between the radial wound brushes 8*a*, 8*b*. A suitable solvent is then fed into the inlet 20, preferably under pressure, and passes into the manifold 4 and up into the jet nozzles 18. When the motor 46 is powered, the output shaft 48, drive motor pulley 50 and drive belt 52 begin to rotate, which imparts rotation to the V-pulley 14. As the V-pulley 14 turns, the support column 42*a* and gear 6*a* of the radial wound brush 8*a* turn and cause gear 6*b* to turn thereby imparting rotation to support column 42*b* and to radial wound brush 8*b* to clean paintbrushes 16 and to move cleaning fluid up and forward from the central space 10 to the paintbrushes 16.

A combination of immersion, water agitation, water injection and rotating brushes cleans the paintbrushes within approximately ninety seconds. The cleaned paintbrushes 16 may then be removed from the device for use or moved to the paintbrush dryer to make room in the central space 10 for additional paintbrushes.

While the present invention has been described with regards to particular embodiments, it is recognized that additional variations of the present invention may be devised without departing from the inventive concept.

What is claimed is:

1. An improved paint brush cleaning device, said device comprising:

(a) a housing having closed sides and a bottom defining an interior, said interior comprising a central space containing paint brush cleaning liquid and a top opening accessible to said central space;

(b) a means for removably mounting paintbrushes in said top opening so as to depend into said central space for cleaning by said paintbrush cleaning liquid;

(c) at least a first paintbrush scrubbing means and a second paintbrush scrubbing means, the first and second paintbrush-scrubbing means each having a length and an outer surface and being rotatably mounted in said central space to contact said paintbrushes;

(d) a means for rotating said first and second paintbrush-scrubbing means to clean said paintbrushes; wherein (e) the first and second paintbrush-scrubbing means comprise elongated cleaning elements disposed in a spiral arrangement along their respective outer surfaces, and wherein the first and second paintbrush scrubbing means are disposed in the central space such that a distance lies between the first and second paintbrush scrubbing means and the elongated cleaning elements disposed on the first paintbrush scrubbing means do not contact the elongated cleaning elements disposed on the second paintbrush scrubbing means.

2. The improved paint brush cleaning device of claim 1 wherein the elongated cleaning elements comprise bristle end tips at their distal ends and where in the distance between the distal end tips disposed on the first paintbrush scrubbing means and the distal end tips disposed on the second paintbrush scrubbing means is between approximately 0.5 cm and approximately 25.0 cm.

3. The device of claim 2 wherein the distance between the distal end tips on the first paintbrush scrubbing means and the distal end tips on the second paintbrush scrubbing means is between approximately 1.0 cm and approximately 10.0 cm from the distal end tips disposed on the second paintbrush scrubbing means.

4. The device of claim 3 wherein the distance between the distal end tips on the first paintbrush scrubbing means and the distal end tips on the second paintbrush scrubbing means is between approximately 1.0 cm and approximately 5.0 cm.

5. The improved paintbrush-cleaning device of claim 4 wherein the distance between the distal end tips is between approximately 1.0 cm and approximately 3.0 cm.

6. The improved paintbrush-cleaning device of claim 1 wherein the plurality of elongated cleaning elements is configured in a spiral pattern along substantially the entire length of the first and second paintbrush-scrubbing means.

7. The improved paintbrush-cleaning device of claim 1 further comprising a paintbrush cleaning fluid disposed in the central space for cleaning the paintbrushes.

8. The improved paintbrush cleaning device of claim 7 wherein the paintbrush cleaning fluid is disposed below the paintbrushes.

9. The improved paintbrush cleaning device of claim 8 further comprising an impeller pump and wherein the impeller pump is connected to a manifold that re-circulates cleaning fluid in the central space.

10. The improved paintbrush cleaning device of claim 1 wherein at least one of the first and second paintbrush-scrubbing means bears gears that communicate with a drive gear.

11. The improved paint brush cleaning device of claim 1 further comprising a means for forcefully impelling a stream of paintbrush cleaning fluid towards the paintbrushes.

12. The improved paintbrush cleaning device of claim 1 wherein the first and second paintbrush scrubbing means rotate towards the interior of the housing.

13. An improved paintbrush cleaning device, said device comprising:

(a) a housing having closed sides and a bottom defining an interior, said interior comprising a central space containing paintbrush cleaning liquid and a top opening accessible to said central space;

(b) a means for removably mounting paintbrushes in said opening so as to depend into said central space for cleaning by said cleaning liquid;

(c) at least a first paintbrush-scrubbing means and a second paintbrush-scrubbing means, the first and second paintbrush-scrubbing means being rotatably mounted in said central space to contact said paintbrushes;

(d) a means for rotating the first and second paintbrush-scrubbing means to clean said paintbrushes;

(e) a plurality of jet nozzles disposed in said central space for cleaning the paintbrushes, wherein the plurality of jet nozzles communicates with a manifold;

(f) means for forcefully impelling a stream of said cleaning liquid through said manifold and jet nozzles substantially toward said paintbrushes so that said stream of cleaning liquid and the first and second paintbrush-scrubbing means act upon the paintbrushes to effect cleaning thereof, and wherein the first and second paintbrush-scrubbing means comprise a plurality of bristles configured in a spiral pattern along their length and wherein the first and second paintbrush-scrubbing means are disposed in the central space such that a distance lies between the first and second paintbrush scrubbing means, and wherein the plurality of bristles disposed on the first paintbrush scrubbing means do not contact the plurality of bristles on the second paintbrush scrubbing means.

14. The paintbrush cleaning device of claim 13 wherein the plurality of jet nozzles comprise individual jet nozzles, each having an upper end and wherein the upper end is angled at approximately thirty (30) degrees to approximately sixty (60) degrees.

15. The paintbrush cleaning device of claim 14 wherein an internal diameter of the jet nozzle is smaller than an internal diameter of the manifold.

16. The paintbrush cleaning device of claim 13 wherein the first and second paintbrush scrubbing means rotate towards the interior of the housing.

17. The paintbrush cleaning device of claim 13, wherein the first paintbrush-scrubbing means is spaced approximately one (1) inch to approximately five (5) inches from a first sidewall of the central space and wherein the second paintbrush scrubbing means is spaced approximately one (1) inch to approximately five (5) inches from a second sidewall of the central space.

18. The paintbrush cleaning device of claim 17, wherein the first and second paintbrush-scrubbing means are spaced, respectively, approximately three (3) inches from the first and second sidewalls of the central space.

19. A paintbrush cleaning device comprising:

(a) a housing having closed sides and a bottom defining an interior, the interior comprising a central space containing a paintbrush cleaning fluid and a top opening accessible to said central space;

(b) a means for mounting paintbrushes in said top opening so as to depend into said central space for cleaning by said paintbrush cleaning fluid;

(c) at least a first radial brush and a second radial brush, the first and second radial brushes having a length and being rotatably mounted in said central space; and (d) the first radial brush and second radial brush being spaced at a distance between approximately 6.0 cm and approximately 9.0 cm from, respectively a first and a second sidewall in said central space to contact said paintbrushes; wherein (i) the first and second radial brushes comprise cleaning bristles having bristle end tips and wherein the cleaning bristles are configured in a spiral pattern along substantially the entire length of the first and second radial brushes; and (ii) wherein the first and second radial brushes are spaced in the central space so that a distance between approximately 1.0 cm and approximately 2.0 cm lies between the bristle end tips of the first radial brush and the bristle end tips of the second radial brush;

(e) a plurality of jet nozzles for cleaning the paint brushes, wherein the plurality of jet nozzles communicate with a manifold, said manifold having a top and being disposed in said central space; wherein (i) the plurality of jet nozzles comprise individual jet nozzles, each jet nozzle comprising a top end and wherein the top end is angled at an angle between approximately thirty (30) to approximately sixty (60) degrees; and wherein (ii) the jet nozzles extend a distance from the top of the manifold and wherein the distance is from approximately 7.0 cm to approximately 9.0 cm; and wherein (iii) the jet nozzles have an internal diameter, said internal diameter being from approximately 0.1 cm to approximately 0.5 cm;

(f) means for forcefully impelling a stream of said paintbrush cleaning fluid through said jet nozzles substantially towards said paintbrushes so that said stream of paintbrush cleaning fluid and the first and second radial brushes act upon the paintbrushes to effect cleaning thereof; and wherein the first and second radial brushes rotate towards the interior of the housing.

20. The paintbrush cleaning device of claim 19, wherein the first and second radial brushes are spaced from approximately 7.0 cm to approximately 8.0 cm from, respectively, the first sidewall and the second sidewall in said central space.

21. The paintbrush cleaning device of claim 19, wherein the internal diameter of the jet nozzles is from approximately 0.1 cm to approximately 0.2 cm.

22. A method to clean a paintbrush, comprising:

(a) removably mounting the paintbrush to depend into a central space containing paintbrush cleaning fluid, the central space being disposed in an interior of a housing having a top opening and having closed sides and a bottom that define the interior;

(b) forcefully impelling a stream of said paintbrush cleaning fluid through at least one jet nozzle disposed in said central space below said paintbrush substantially towards said paintbrush;

(c) contacting the paintbrush with a pair of rotating paintbrush-scrubbing means disposed in said central space so that said stream of paintbrush cleaning fluid and paintbrush-scrubbing means act upon the paintbrush to effect cleaning thereof; and wherein the paintbrush-scrubbing means comprise a plurality of bristles comprising bristle end tips, and wherein said plurality of bristles are configured in a spiral pattern along the length of the paintbrush scrubbing means; and wherein the paintbrush scrubbing means comprise a first radial brush and a second radial brush disposed in the central space such that a space exists between the plurality of bristles on the first and second radial brushes, and wherein the bristle end tips on the first radial brush do not contact the bristle end tips on the second radial brush.

* * * * *